US009341045B1

(12) United States Patent
Ross

(10) Patent No.: US 9,341,045 B1
(45) Date of Patent: May 17, 2016

(54) CONFIGURABLE SUBSEA TREE MASTER VALVE BLOCK

(71) Applicant: GE Oil & Gas UK Limited, Aberdeen (GB)

(72) Inventor: Michael Stanley McRobbie Ross, Aberdeen (GB)

(73) Assignee: GE Oil & Gas UK Limited, Aberdeen (GB)

( * ) Notice: Subject to any disclaimer, the term of this patent is extended or adjusted under 35 U.S.C. 154(b) by 0 days.

(21) Appl. No.: 14/559,424

(22) Filed: Dec. 3, 2014

(51) Int. Cl.
*E21B 34/04* (2006.01)
*E21B 33/035* (2006.01)
*E21B 33/043* (2006.01)

(52) U.S. Cl.
CPC ..... *E21B 34/04* (2013.01); *E21B 33/035* (2013.01); *E21B 33/043* (2013.01)

(58) Field of Classification Search
CPC ..... E21B 34/04; E21B 33/035; E21B 33/043; E21B 33/047; E21B 33/076; E21B 43/12; E21B 41/0007
USPC ..... 166/368
See application file for complete search history.

(56) References Cited

U.S. PATENT DOCUMENTS

| | | | | |
|---|---|---|---|---|
| 6,357,529 | B1 * | 3/2002 | Kent | E21B 34/04 166/344 |
| 6,378,613 | B1 | 4/2002 | Kent et al. | |
| 7,093,660 | B2 * | 8/2006 | Hopper | E21B 33/03 166/348 |
| 7,201,229 | B2 * | 4/2007 | White | E21B 43/01 166/344 |
| 8,371,385 | B2 * | 2/2013 | Lewis | E21B 33/035 166/341 |
| 2003/0150620 | A1 * | 8/2003 | DeBerry | E21B 33/043 166/368 |
| 2005/0028984 | A1 * | 2/2005 | Donald | E21B 33/035 166/368 |

FOREIGN PATENT DOCUMENTS

WO 2014081310 A1 5/2014

* cited by examiner

*Primary Examiner* — James G Sayre
(74) *Attorney, Agent, or Firm* — Bracewell LLP

(57) ABSTRACT

A pre-machined forging for use with a subsea hydrocarbon assembly includes a common master valve block. The common master valve block has an upper cylindrical portion with a main central axis. A lower cylindrical portion of the common master valve block includes a lower axis that is parallel to, and offset from, the main central axis. A valve portion of the common master valve block is located axially between the upper cylindrical portion and the lower cylindrical portion. A main bore extends axially through the common master valve block from a bottom end of the common master valve block to a top end of the common master valve block along the main central axis.

20 Claims, 6 Drawing Sheets

CONFIGURABLE SUBSEA TREE MASTER VALVE BLOCK

BACKGROUND

1. Field of Invention

This invention relates in general to offshore drilling and production equipment and in particular to a subsea tree assembly with a configurable master valve block.

2. Description of Related Art

Subsea wellhead assemblies are typically used in the production of hydrocarbons extracted from subterranean formations below the seafloor. Subsea wellhead assemblies generally comprise a wellhead housing disposed at a wellbore opening, where the wellbore extends through one or more hydrocarbon producing formations. Casing and tubing hangers are landed within the housing for supporting casing and production tubing inserted into the wellbore. The hangers can have dual bore or mono bore configurations. The casing lines the wellbore, thereby isolating the wellbore from the surrounding formation. Tubing typically lies concentric within the casing and provides a conduit for producing the hydrocarbons entrained within the formation. Wellhead assemblies also typically include subsea trees, also known as Christmas trees, connected to the upper end of the wellhead housing. The subsea trees control and distribute the fluids produced from the wellbore.

Subsea trees are installed on the wellhead housing, tubing head, or tubing hanger spool. The subsea tree includes a valve block that contains flow lines, valves, and actuators for controlling the flow of fluid into and out of the wellhead assembly, such as controlling and distributing the fluids produced from the wellbore. Valve blocks can have a variety of configurations and are sometimes customized, designed, and fabricated as one-off or limited production equipment.

SUMMARY OF THE DISCLOSURE

Embodiments of the current disclosure provide methods and systems with a subsea tree master valve block design which can accommodate multiple dual bore and mono-bore configurations and multiple fully internal main bore to annulus bore cross-over configurations in a single predesigned configurable valve block. Using the configurable common master valve block of the embodiments of this disclosure can significantly reduce the lead time for delivery of a master valve block because the common master valve block can be configured to accommodate multiple configurations, instead of having to custom fabricate a one-off master valve block after the customer has placed an order. In addition, the location of the outlets of systems and method of this disclosure are standardized so that equipment that is attached to the master valve block, such as the tree frame, the flow control module, the flow spools, the flowline connections, and other required equipment related to the subsea tree are also in common locations in a preset configuration reducing engineering time and costs for each option.

In an embodiment of this disclosure, a pre-machined forging for use with a subsea hydrocarbon assembly includes a common master valve block. The common master valve block has an upper cylindrical portion with a main central axis. A lower cylindrical portion of the common master valve block includes a lower axis that is parallel to, and offset from, the main central axis. A valve portion of the common master valve block is located axially between the upper cylindrical portion and the lower cylindrical portion. A main bore extends axially through the common master valve block from a bottom end of the common master valve block to a top end of the common master valve block along the main central axis.

In an alternate embodiment of this disclosure, a subsea hydrocarbon assembly includes a dual bore subsea wellhead assembly having a tubing hanger with hanger main bore offset from a tubing hanger central axis of the tubing hanger. A common master valve block is in fluid communication with the dual bore subsea wellhead assembly, the common master valve block having an upper cylindrical portion with a main central axis. A lower cylindrical portion of the common master valve block has a lower axis that is parallel to, and offset from, the main central axis. A main bore extends axially through the common master valve block from a bottom end of the common master valve block to a top end of the common master valve block along the main central axis.

In yet another embodiment of this disclosure, a method of completing a subsea hydrocarbon well includes providing a common master valve block with a main bore. The main bore extends axially through the common master valve block from a bottom end of the common master valve block to a top end of the common master valve block along a main central axis of the common master valve block. The common master valve block has an upper cylindrical portion centered around the main central axis, and a lower cylindrical portion with a lower axis that is parallel to, and offset from, the main central axis. The common master valve block is secured to a subsea assembly. If the subsea assembly has a mono bore subsea wellhead, a lower interface is machined in the bottom end of the common master valve block that is centered around main central axis. If instead the subsea assembly has a dual bore subsea wellhead, a lower interface is machined in the bottom end of the common master valve block that has an eccentric interface axis that is parallel to, and offset from, the main central axis.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

DETAILED DESCRIPTION OF THE DISCLOSURE

Figure 1:
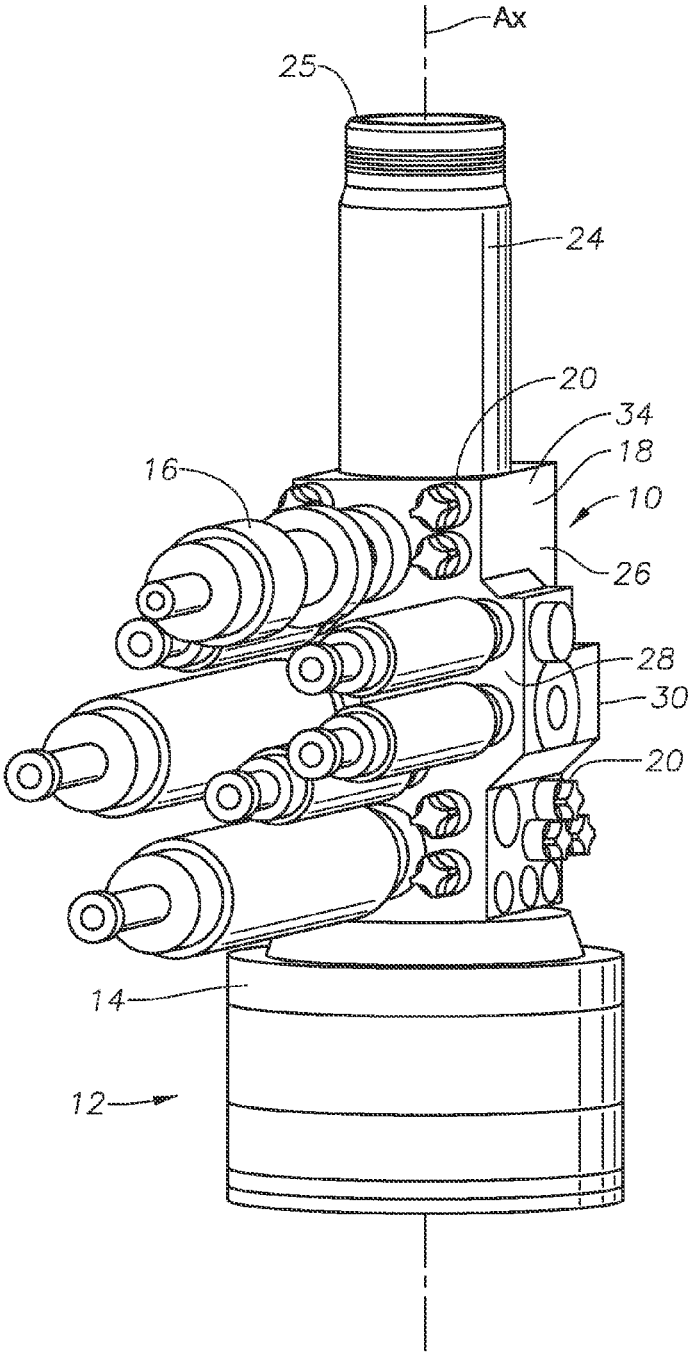
FIG. 1 is a perspective view of an example of a master block assembly with a common master valve block of an embodiment of this disclosure.

The methods and systems of the present disclosure will now be described more fully hereinafter with reference to the accompanying drawings in which embodiments are shown. The methods and systems of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Figure 3:
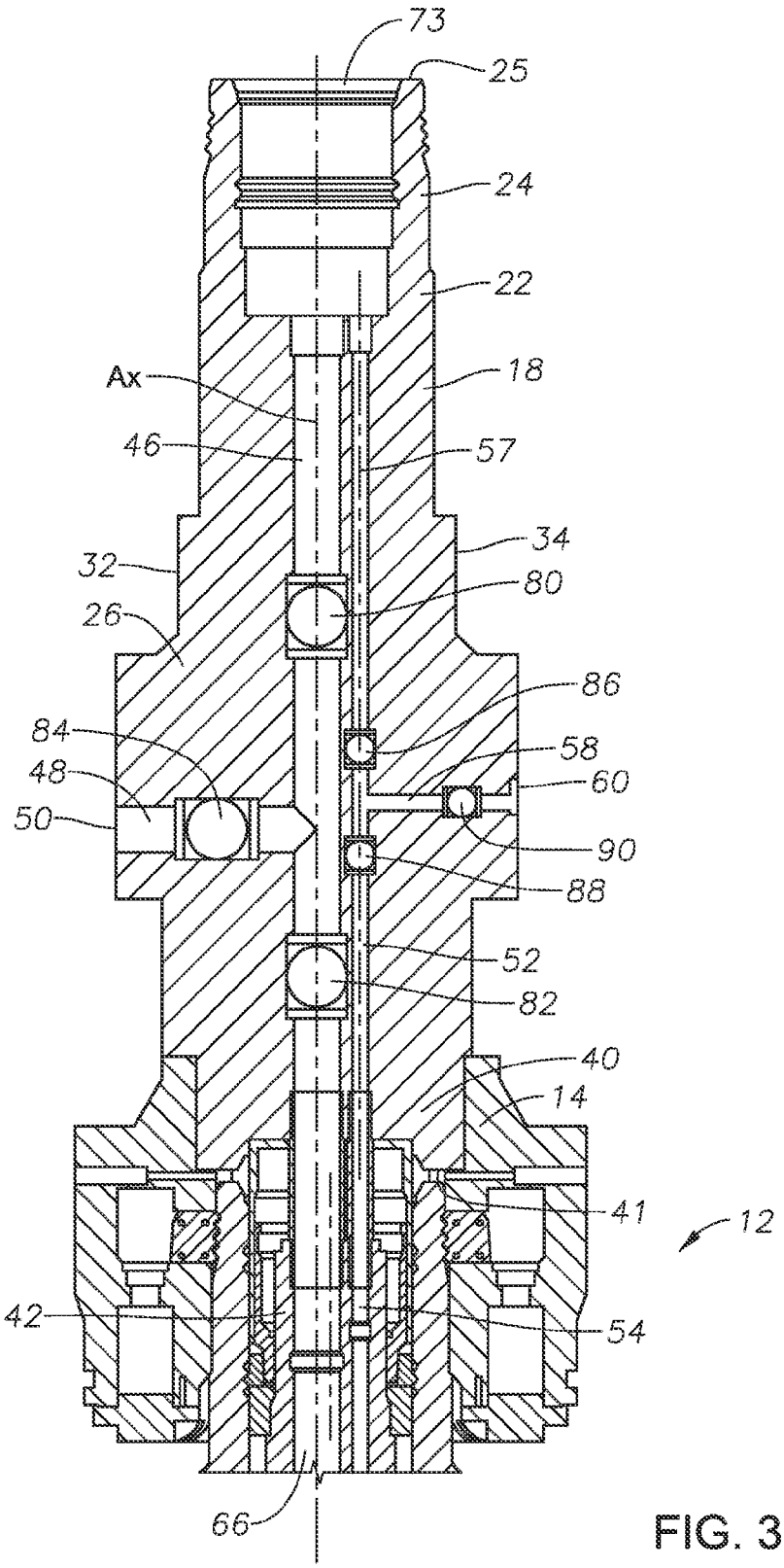
FIG. 3 is a section view of the common master valve block of FIG. 2, shown in a dual bore arrangement with no crossover bores and landed on a subsea wellhead assembly.
Figure 4:
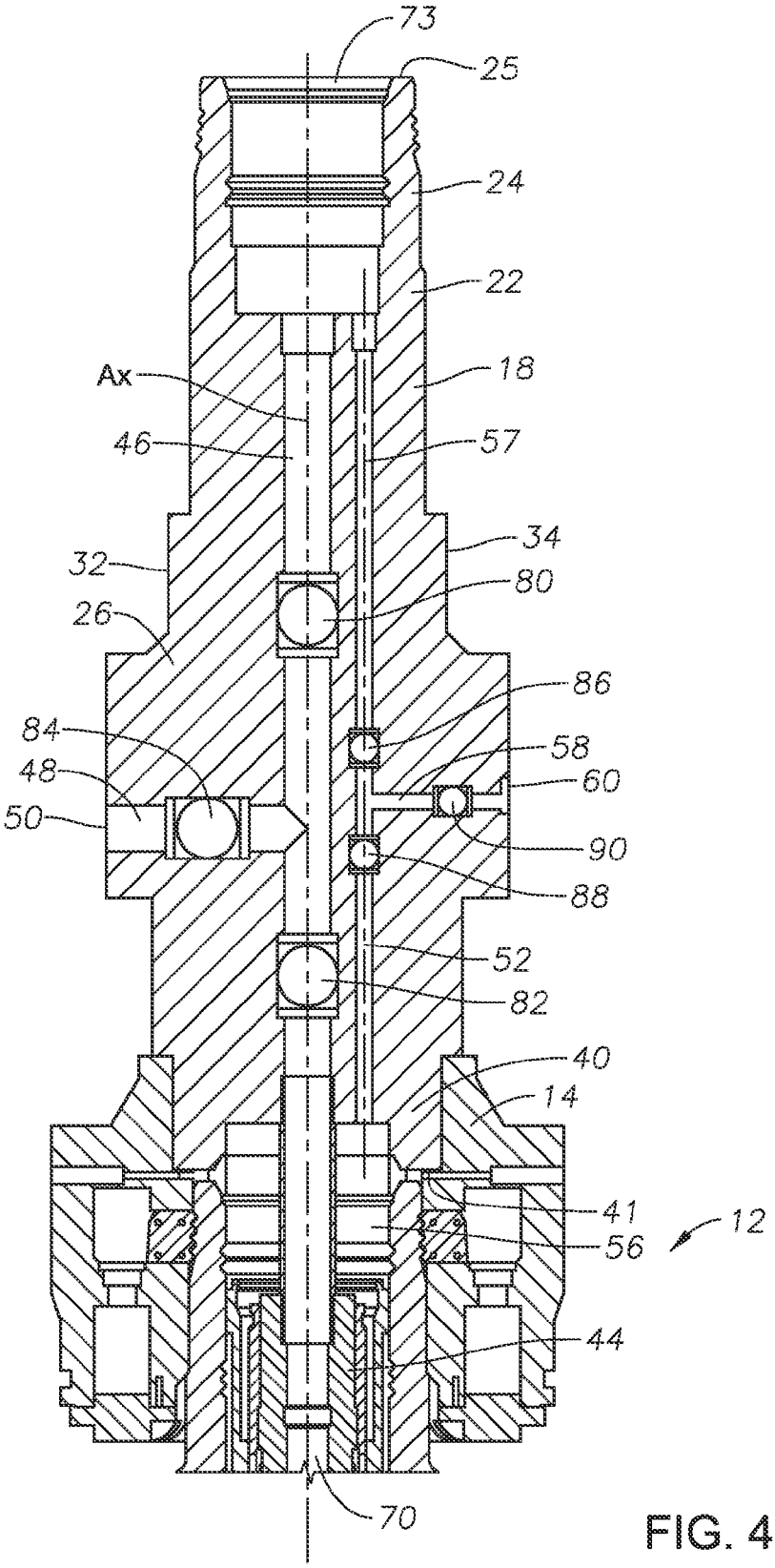
FIG. 4 is a section view of the common master valve block of FIG. 2, shown in a mono bore arrangement with no crossover bores and landed on a subsea assembly.

Referring to FIGS. 1 and 3-4, a configurable pre-machined forging such as master block assembly 10 is shown landed on and secured to subsea wellhead assembly 12 with a wellhead connector 14. Subsea wellhead assembly 12 is located above a subsea well, such as an oil and gas production well. As will be explained in more detail below, master block assembly 10 includes a number of primary valves which are actuated by valve actuators 16. Valve actuators 16 extend outward from valve block 18. Master block assembly 10 also includes a number of smaller isolation valve assemblies 20 for use with chemical injection, controlling downhole hydraulic functions, pressure and temperature sensors, and performing other standard operations that are commonly performed by master block assembly 10. As will be described in further detail below, valve block 18 houses a number of valves and flow lines to direct and control fluids into and out of subsea wellhead assembly 12. Master block assembly 10 can be part of a Christmas tree assembly (not shown) that is secured to subsea wellhead assembly 12.

Looking now at FIGS. 1-6, common master valve block 22 is a forged member with an upper cylindrical portion 24. Upper cylindrical portion 24 has a generally cylindrical shape. Upper cylindrical portion 24 extends downward from top end 25 of common master valve block 22 to valve portion 26. Valve portion 26 is shown, as an example, with a rectangular shape in cross section. Valve portion 26 has a generally planar front face 28. Back face 30 can be a generally planar face opposite front face 28.

First valve block side 32 and second valve block side 34 extend between front face 28 and back face 30. Valve block sides 32, 34 can include surfaces that are generally planar. Valve block sides 32, 34 can include wings 36, 38, respectively, which extend radially past other surfaces of valve block sides 32, 34. First valve block side 32 includes first wing 36 and second valve block side 34 includes second wing 38. Below valve portion 26 of common master valve block 22 is lower cylindrical portion 40. Lower cylindrical portion 40 has a generally cylindrical shape and extends from valve portion 26 to bottom end 41 of common master valve block 22.

Figure 7:
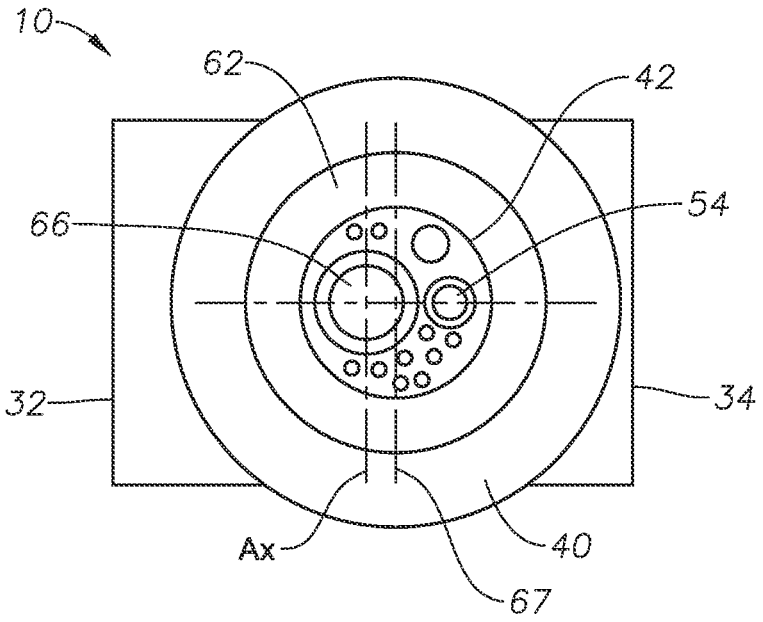
FIG. 7 is a cross sectional view of the common master valve block of FIG. 5, shown looking upward from the dual bore wellhead assembly.
Figure 8:
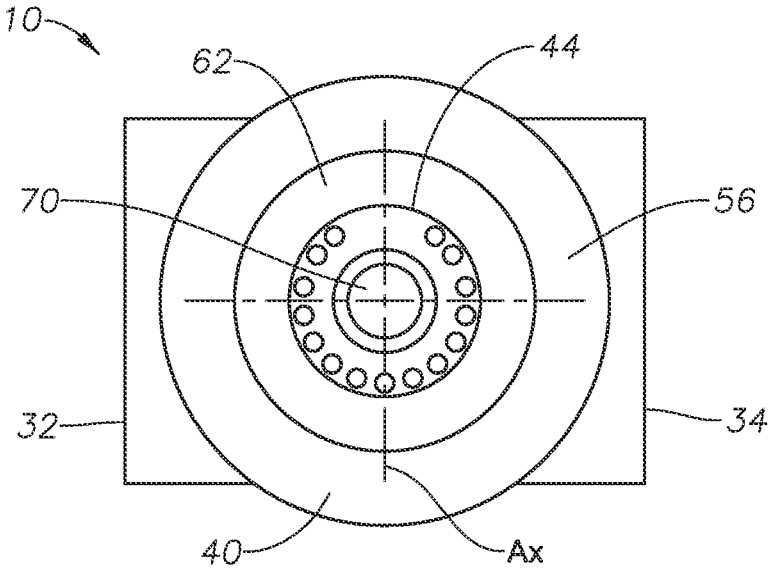
FIG. 8 is a cross sectional view of the common master valve block of FIG. 6, shown looking upward from the mono bore wellhead assembly.

Main central axis Ax extends along a centerline of upper cylindrical portion 24. Upper cylindrical portion 24 can be symmetrical about main central axis Ax. Main central axis Ax can extend through a center of a width of valve portion 26, measured from first valve block side 32 to second valve block side 34 and between a center of depth of valve portion 26, measured from front face 28 to back face 30. Lower cylindrical portion 40 of common master valve block 22 is not symmetrical about main central axis Ax, but is forged with extra material to allow for common master valve block 22 to be configurable for a dual bore tubing hanger 42 (FIGS. 3 and 7) or a mono bore tubing hanger 44 (FIGS. 4 and 8). Lower cylindrical portion 40 is instead offset from main central axis Ax, and centered around lower axis 45 (FIG. 2), which is parallel to main central axis Ax.

Common master valve block 22 includes main bore 46. Main bore 46 extends through common master valve block 22 along main central axis Ax from bottom end 41 of common master valve block 22 to top end 25 of common master valve block 22. Common master valve block 22 can also include main lateral bore 48. Main lateral bore 48 extends from main bore 46 to an outer surface of common master valve block 22. Main bore outlet 50 is located at an end of main bore 46. In the illustrated embodiments, main lateral bore 48 extends generally perpendicular to main central axis Ax of common master valve block 22 from main bore 46 to main bore outlet 50 on first wing 36 so that main bore outlet 50 is in fluid communication with main bore 46.

With main bore 46 and main lateral bore 48, common master valve block 22 is configurable for use with either dual bore tubing hanger 42 or mono bore tubing hanger 44. Because the forging of a custom master valve block can take a significant amount of time, such as a number of months, by having common master valve blocks 22 in stock, a supplier can more quickly and efficiently provide a master block assembly 10 to customers, regardless of whether the customer requires a master block assembly 10 for a dual bore tubing hanger 42 or a mono bore tubing hanger 44. As will be discussed below, common master valve block 22 can be machined in a variety of crossover bore configurations to meet a range of customer requirements.

Looking now at FIGS. 3-6, once the required final configuration for master block assembly 10 is determined, common master valve block 22 can be further machined and completed to form the required valve block 18 for use with a particular Christmas tree assembly. Master block assembly 10 is for use with what is known as a vertical Christmas tree, where the tubing hanger is located below a bottom end of master block assembly 10 in a subsea wellhead or tubing spool. Looking at FIGS. 3-4, subsea wellhead assembly 12 can include either dual bore tubing hanger 42 (FIG. 3) or mono bore tubing hanger 44 (FIG. 4), which is landed in, and sealingly secured to, an inner bore of subsea wellhead assembly 12.

Master block annulus bore 52 can be machined in common master valve block 22. Master block annulus bore 52 can extend axially through common master valve block 22 from bottom end 41 of the common master valve block 22 to top end 25 of the common master valve block 22 along annulus axis 57, which is offset from and parallel to, main bore 46 and main central axis Ax. Master block annulus bore 52 has a smaller diameter than a diameter of main bore 46.

In the example embodiments shown, master block annulus bore 52 is offset from main central axis Ax and closer to valve block second side 34 than main bore 46. As can be seen in FIGS. 3-4 and 7-8, if master block assembly 10 is to be used with dual bore tubing hanger 42, master block annulus bore 52 is in fluid communication with, and can mate with, tubing hanger annulus bore 54 that is within dual bore tubing hanger 42. If master block assembly 10 is to be used with mono bore tubing hanger 44, master block annulus bore 52 is open to, and in fluid communication with, outer bore space 56 that is an annular space radially outside of mono bore tubing hanger 44. Therefore, if master block assembly 10 is to be used with dual bore tubing hanger 42, master block annulus bore 52 is located closer to main bore 46 than if master block assembly 10 is to be used with a mono bore tubing hanger 44.

Annulus lateral bore 58 can also be machined in common master valve block 22. Annulus lateral bore 58 extends from master block annulus bore 52 to an outer surface of common master valve block 22. Annulus bore outlet 60 is located at an end of annulus lateral bore 58. In the illustrated embodiments of FIGS. 3-6, annulus lateral bore 58 is generally perpendicular to main central axis Ax of common master valve block 22 from master block annulus bore 52 to annulus bore outlet 60 on second wing 38, so that annulus bore outlet 60 is in fluid communication with master block annulus bore 52.

Both main bore outlet 50 and annulus bore outlet 60 can be machined into the outer surface of the common master valve block 22 in a position that is predetermined and standardized or common between all valve blocks 18 irrespective of whether the common master valve block 22 is being configured for dual bore tubing hanger 42 or mono bore tubing hanger 44. This allows for the equipment that is attached to the master valve block, such as the tree frame, the flow control module, the flow spools, the flowline connections, and other required equipment related to the subsea tree to also be standardized, resulting in additional time and cost efficiencies in supplying subsea trees.

Figure 5:
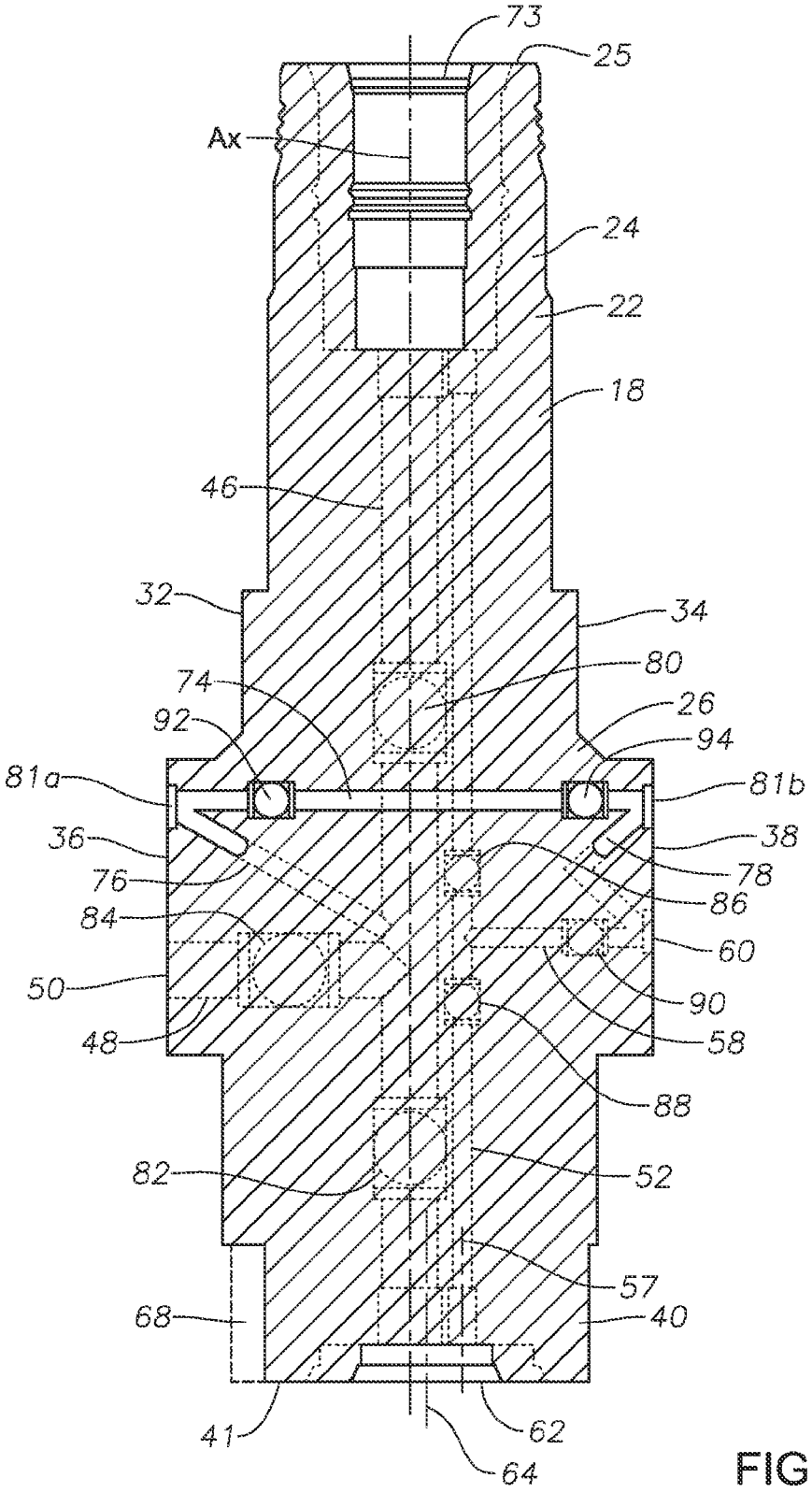
FIG. 5 is a section view of the common master valve block of FIG. 2, shown in a dual bore arrangement with a crossover bore that extends to the inside of the production wing valve and the outside of the annulus wing valve.

Lower interface 62 is machined in bottom end 41 of common master valve block 22. Lower interface 62 can be machined to match either dual bore tubing hanger 42 or mono bore tubing hanger 44. When lower interface 62 is machined to match dual bore tubing hanger 42, lower interface 62 is machined eccentrically to main central axis Ax of common master valve block 22 to form lower interface 62 with eccentric interface axis 64 (FIGS. 3, 5, and 7). In such an embodiment, main bore 46 aligns with dual bore tubing hanger main bore 66.

Dual bore tubing hanger main bore 66 is centered a main central axis Ax of common master valve block 22. However, in order to be able to also fit tubing hanger annulus bore 54 within dual bore tubing hanger 42, dual bore tubing hanger main bore 66 is offset from eccentric interface axis 64, which is collinear with dual bore tubing hanger central axis 67 of dual bore tubing hanger 42. In order for lower cylindrical portion 40 to be centered around eccentric interface axis 64, an outer surface of common master valve block 22 proximate to bottom end 41 can be machined to remove dual bore excess material 68 of lower cylindrical portion 40. The location of the excess material is determined by the location of lower interface 62. In the example embodiment of FIGS. 3, 5, and 7, dual bore excess material 68 is on a region of lower cylindrical portion 40 that is closer to central Ax than to eccentric interface axis 64.

Figure 6:
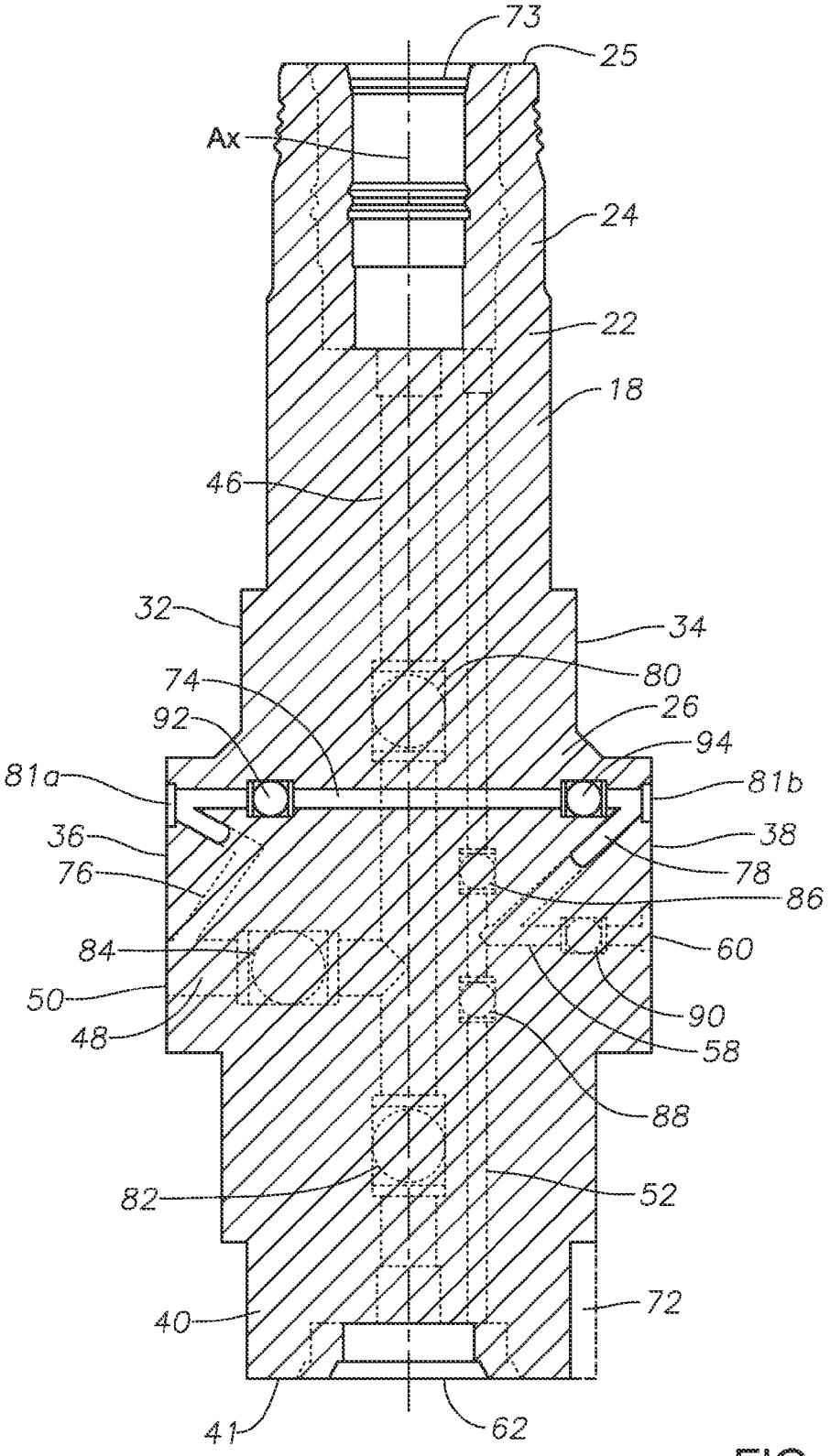
FIG. 6 is a section view of the common master valve block of FIG. 2, shown in a mono bore arrangement with a crossover bore that extends to the outside of the production wing valve and the inside of the annulus wing valve.

When lower interface 62 is machined to match mono bore tubing hanger 44, lower interface 62 is machined concentrically to central axis Ax of common master valve block 22 to form lower interface 62 that has a central axis that is collinear with central axis Ax (FIGS. 4, 6, and 8). In such an embodiment, main bore 46 aligns with central axis Ax.

Mono bore tubing hanger main bore 70 is centered on central axis Ax of common master valve block 22. Because outer bore space 56 is outside of mono bore tubing hanger 44, mono bore tubing hanger main bore 70 can be centered around central axis Ax. In order for lower cylindrical portion 40 to be centered around central axis Ax, an outer surface of common master valve block 22 proximate to bottom end 41 can be machined to remove mono bore excess material 72 to reshape lower cylindrical portion 40. The location of the excess material is determined by the location of lower interface 62. In the example embodiment of FIGS. 4, 6, and 8, mono bore excess material 72 is on a region of lower cylindrical portion 40 that is closer to master block annulus bore 52 than to main bore 46.

Upper interface 73 can be machined proximate to top end 25 of common master valve block 22. Upper interface 73 can include both inner diameter and outer diameter profiles so that valve block 18 can interface with other members (not shown). As an example, upper interface 73 can mate with a blowout preventer, an interior bore cap, an outer debris cap, workover well control package, or other subsea members known in the art.

Looking at FIGS. 5-6, at least one crossover bore 74 can be machined in common master valve block 22. Crossover bore 74 can provide fluid communication between main bore 46 and master block annulus bore 52. Crossover bore 74 can also provide fluid communication between main bore 46, master block annulus bore 52, main bore outlet 50 and annulus bore outlet 60. Crossover bore 74 can be in fluid communication with main bore crossover portion 76 and annulus bore crossover portion 78. As will be discussed in further detail below, main bore crossover portion 76 and annulus bore crossover portion 78 can have a variety of configurations.

Continuing to look at FIGS. 3-6, valve block 18 can include a number of valves to regulate and control fluids flowing through valve block 18. Production swab valve 80 is located along main bore 46 axially above main lateral bore 48. Production master valve 82 is located along main bore 46 axially below main lateral bore 48. Production wing valve 84 is located along main lateral bore 48. Annulus swab valve 86 is located along master block annulus bore 52 axially above annulus lateral bore 58, and annulus master valve 88 is located along master block annulus bore 52 axially below annulus lateral bore 58. Annulus wing valve 90 is located along annulus lateral bore 58. Main bore crossover valve 92 is located along crossover bore 74 on a side of valve block 18 closer to main bore 46 than master block annulus bore 52. Annulus bore crossover valve 94 is located along crossover bore 74 on a side of valve block 18 closer to master block annulus bore 52 than main bore 46.

Regardless of the configuration of main bore crossover portion 76 and annulus bore crossover portion 78, crossover bore 74 has main bore crossover outlet 81*a* and annulus bore crossover outlet 81*b* which can be located on opposite sides of common master valve block 22. Main bore crossover outlet 81*a* and annulus bore crossover outlet 81*b* are openings to an outside of common master valve block 22. Crossover bore 74 extends from main bore crossover outlet 81*a* to annulus bore crossover outlet 81*b*.

In the example embodiments shown, main bore crossover outlet is located on first wing 36 and annulus bore crossover outlet is located on second wing 38. Main bore crossover outlet 81*a* and annulus bore crossover outlet 81*b* are located at a location that is predetermined and standardized or common between all valve blocks 18 irrespective of the configuration of main bore crossover portion 76 or annulus bore crossover portion 78, and irrespective of whether common master valve block 22 is being configured for dual bore tubing hanger 42 or mono bore tubing hanger 44. This allows for the equipment that is attached to the master valve block, such as the tree frame, the flow control module, the flow spools, the flowline connections, and other required equipment related to the subsea tree to also be common, resulting in additional time and cost efficiencies in supplying subsea trees.

Main bore crossover portion 76 and annulus bore crossover portion 78 can have a variety of configurations, as illustrated in FIGS. 3-6. As an example, main bore crossover portion 76 can have an end that meets crossover bore 74 proximate to main bore crossover outlet 81*a* and extend radially inward along a straight path to fluidly communicate with main bore 46 radially interior of production wing valve 84 (FIG. 5). Alternately, main bore crossover portion 76 can have an end that meets crossover bore 74 proximate to main bore crossover outlet 81*a*, first extend radially inward, then switch directions and extend radially outward to meet main bore 46 radially exterior of production wing valve 84 (FIG. 6) Annulus bore crossover portion 78 can similarly have an end that meets crossover bore 74 proximate to annulus bore crossover outlet 81*b* and extend radially inward along a straight path to fluidly communicate with master block annulus bore 52 radially interior of annulus wing valve 90 (FIG. 6). Alternately, annulus bore crossover portion 78 can have an end that meets crossover bore 74 proximate to annulus bore crossover outlet 81*b*, first extend radially inward, then switch directions and extend radially outward to meet master block annulus bore 52 radially exterior of annulus wing valve 90 (FIGS. 5). In addition to the examples shown in FIGS. 5 and 6, both main bore crossover portion 76 and annulus bore crossover portion 78 can meet main bore 46 radially interior of production wing valve 84 and master block annulus bore 52 radially interior of annulus wing valve 90, respectively; or both main bore crossover portion 76 and annulus bore crossover portion 78 can meet main bore 46 radially exterior of production wing valve 84 and master block annulus bore 52 radially exterior of annulus wing valve 90.

Regardless of configuration main bore 46, production master valve 82, production wing valve 84, production swab valve 80, main lateral bore 48, main bore outlet 50, annulus lateral bore 58, annulus bore outlet 60, annulus wing valve 90, main bore crossover valve 92, annulus bore crossover valve 94, crossover bore 74, main bore crossover outlet 81*a* and annulus bore crossover outlet 81*b*, all of the isolation valve assemblies 20 and all pressure and temperature sensors are all in common locations.

Figure 2:
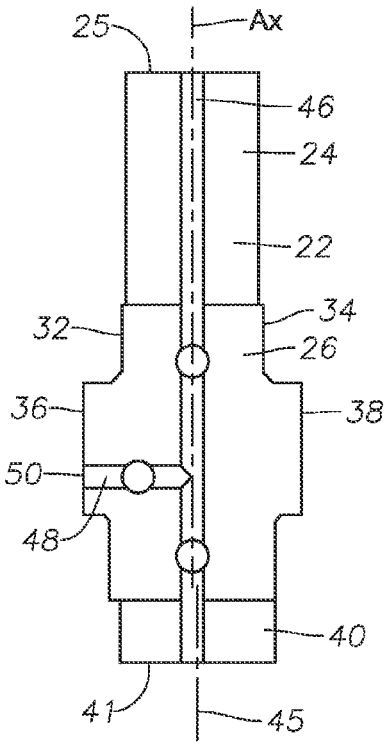
FIG. 2 is a section view of an example of a common master valve block forging of an embodiment of this disclosure.

In an example of operation, looking at FIG. 2, common master valve block 22 can be forged with main bore 46 and then heat treated to harden the material forming common master valve block 22. Main lateral bore 48 can then be machined, creating a common master valve block 22 that is configurable for dual bore tubing hanger (FIGS. 3 and 7) or mono bore tubing hanger (FIGS. 4 and 8). A supplier can maintain an inventory of common master valve blocks 22 formed in this way and can significantly reduce the lead time for providing valve block 18 to a customer.

After a customer places an order, master block annulus bore 52 can be machined axially through common master valve block 22 from bottom end 41 of the common master valve block 22 to top end 25 of the common master valve block 22. Looking at FIGS. 3-6, lower interface 62 can be machined in bottom end 41 of common master valve block 22. The radial location of master block annulus bore 52 and lower interface 62 are determined in part by whether valve block 18 is to be used with dual bore tubing hanger (FIGS. 3 and 7) or mono bore tubing hanger (FIGS. 4 and 8).

Upper interface 73 can be machined proximate to top end 25 of common master valve block 22. Crossover bore 74 can also be machined in common master valve block 22, as well as main bore crossover portion 76 and annulus bore crossover portion 78. The configuration of main bore crossover portion 76 and annulus bore crossover portion 78 will depend on customer requirements. Because crossover bore 74, main bore crossover portion 76, and annulus bore crossover portion 78 are all integrally formed within common master valve block 22, instead of having some external portions as is done with some current valve blocks 18, the size and complexity of valve block 18 can be reduced, as well as the number of components needed and the number of connections to be made. This in turn reduces potential leak sources.

Main bore outlet 50, annulus bore outlet 60, main bore crossover outlet 81*a* and annulus bore crossover outlet 81*b* can be machined in common master valve block 22, and will be positioned at location that are predetermined and standardized or common between all valve blocks 18 irrespective of the configuration of main bore crossover portion 76 or annulus bore crossover portion 78, and irrespective of whether common master valve block 22 is being configured for dual bore tubing hanger 42 or mono bore tubing hanger 44.

Production swab valve 80, production master valve 82, production wing valve 84, annulus swab valve 86, annulus master valve 88, annulus wing valve 90, main bore crossover valve 92, and annulus bore crossover valve 94 are each considered to be primary valves and can be added to common master valve block 22. Looking at FIG. 1, a valve actuator 16 can be associated with each of the primary valves. Valve actuators 16 extend from the front face 28 of common master valve block 22. Isolation valve assemblies 20 can also extend from front face 28 to complete master block assembly 10. Master block assembly 10 can be provided to the customer as part of a Christmas tree assembly.

Master block assembly 10, as part of the Christmas tree assembly, can then be landed on and secured to a subsea wellhead assembly 12. If subsea wellhead assembly 12 includes dual bore tubing hanger 42, main bore 46 is mated to dual bore tubing hanger main bore 66 to form a fluid communication between main bore 46 and dual bore tubing hanger main bore 66 (FIGS. 3 and 7). In such an embodiment, master block annulus bore 52 is mated to and is in fluid communication with tubing hanger annulus bore 54.

Looking now at FIGS. 4 and 8, if subsea wellhead assembly 12 includes mono bore tubing hanger 44, main bore 46 is mated to mono bore tubing hanger main bore 70 to form a fluid communication between main bore 46 and mono bore tubing hanger main bore 70. In such an embodiment, master block annulus bore 52 is in fluid communication with outer bore space 56 so that fluid in master block annulus bore 52 can fill the annular space around mono bore tubing hanger main bore 70. Because no equipment is expected to be run through master block annulus bore 52 and lower into outer bore space 56, a direct path from master block annulus bore 52 through to a lower annulus bore (not shown) axially below mono bore tubing hanger 44 is required. Therefore after fluid enters outer bore space 56 from master block annulus bore 52, it can then enter the lower annulus bore by way of a separate annulus bore that circumvents the seals between mono bore tubing hanger 44 and an inner bore of subsea wellhead assembly 12.

Valve block 18 may be insulated before being installed at the well. Because crossover bore 74, main bore crossover portion 76, and annulus bore crossover portion 78 are all integrally formed within common master valve block 22, insulating valve block 18 will be simpler than if crossover bore 74, main bore crossover portion 76, and annulus bore crossover portion 78 were external to common master valve block 22. In addition, the integrally formed crossover bore 74, main bore crossover portion 76, and annulus bore crossover portion 78 are themselves less susceptible to heat loss than if they were formed external to common master valve block 22. This allows valve block 18 to be particularly well suited to deep water applications where the water temperature is low.

Therefore systems and methods of this disclosure provide a valve block 18 that can be provided to a customer with a reduced fabrication lead time and reduced engineering hours compared to what would be required for providing a custom and non standardized master valve block. Tooling for machining valve block 18 can also be standardized and fabrication efficiencies will be realized as such tooling is able to be reused for machining successive common master valve blocks 22.

The terms "vertical", "horizontal", "upward", "downward", "above", and "below" and similar spatial relation terminology are used herein only for convenience because elements of the current disclosure may be installed in various relative positions.

The system and method described herein, therefore, are well adapted to carry out the objects and attain the ends and advantages mentioned, as well as others inherent therein. While a presently preferred embodiment of the system and method has been given for purposes of disclosure, numerous changes exist in the details of procedures for accomplishing the desired results. These and other similar modifications will readily suggest themselves to those skilled in the art, and are intended to be encompassed within the spirit of the system and method disclosed herein and the scope of the appended claims.

What is claimed is:

1. A configurable pre-machined forging for use with a subsea hydrocarbon assembly, the pre-machined forging comprising:

a common master valve block, the common master valve block having:

an upper cylindrical portion with a main central axis;

a lower cylindrical portion with a central lower axis of an outer diameter of the lower cylindrical portion that is parallel to, and radially offset from, the main central axis;

a valve portion that is located axially between the upper cylindrical portion and the lower cylindrical portion; and a main bore, the main bore extending axially through the common master valve block from a bottom end of the common master valve block to a top end of the common master valve block along the main central axis.

2. The pre-machined forging according to claim 1, further comprising:

a main lateral bore extending from the main bore to an outer surface of the common master valve block; and a lower interface in the bottom end of the common master valve block, the lower interface being machined to match one of a dual bore tubing hanger and a mono bore tubing hanger.

3. The pre-machined forging according to claim 2, wherein:

when the lower interface is machined to match the dual bore tubing hanger, the lower interface is eccentric to the main central axis; and when the lower interface is machined to match the mono bore tubing hanger, the lower interface is concentric with the main central axis.

4. The pre-machined forging according to claim 2, wherein:

when the lower interface is machined to match the dual bore tubing hanger, the lower cylindrical portion is reshaped and eccentric to the main central axis; and when the lower interface is machined to match the mono bore tubing hanger, the lower interface is reshaped and concentric with the main central axis.

5. The pre-machined forging according to claim 1, further comprising a master block annulus bore that extends axially through the common master valve block from the bottom end of the common master valve block to the top end of the common master valve block.

6. The pre-machined forging according to claim 5, further comprising at least one crossover bore in the common master valve block, the at least one crossover bore providing fluid communication between the main bore and the master block annulus bore.

7. The pre-machined forging according to claim 5, further comprising:

a main bore outlet in the common master valve block, the main bore outlet located at an end of a main lateral bore that extends from the main bore to an outer surface of the common master valve block;

an annulus bore outlet in the common master valve block, the annulus bore outlet located at an end of an annulus lateral bore that extends from the outer surface of the common master valve block to the master block annulus bore; and wherein a position of the main bore outlet is predetermined and standardized, irrespective of the common master valve block being configured for a dual bore tubing hanger or a mono bore tubing hanger; and a position of the annulus bore outlet is predetermined and standardized, irrespective of the common master valve block being configured for the dual bore tubing hanger or the mono bore tubing hanger.

8. The pre-machined forging according to claim 5, wherein the master block annulus bore is machined to be in fluid communication with a tubing hanger annulus bore within a dual bore tubing hanger.

9. The pre-machined forging according to claim 5, wherein the master block annulus bore is machined to be in fluid communication with an outer bore space that is radially outward from, a mono bore tubing hanger.

10. A subsea hydrocarbon assembly comprising:

a dual bore subsea wellhead assembly having a tubing hanger with a hanger main bore offset from a tubing hanger central axis of the tubing hanger; and a configurable common master valve block in fluid communication with the dual bore subsea wellhead assembly, the common master valve block having:

an upper cylindrical portion with a main central axis;

a lower cylindrical portion with a central lower axis of an outer diameter of the lower cylindrical portion that is parallel to, and radially offset from, the main central axis; and a main bore, the main bore extending axially through the common master valve block from a bottom end of the common master valve block to a top end of the common master valve block and centered around the main central axis.

11. The subsea hydrocarbon assembly according to claim 10, further comprising a lower interface in the bottom end of the common master valve block, the lower interface centered around an eccentric interface axis that is collinear with the tubing hanger central axis.

12. The subsea hydrocarbon assembly according to claim 10, further comprising a master block annulus bore that extends axially through the common master valve block from the bottom end of the common master valve block to the top end of the common master valve block parallel to, and offset from, the main bore.

13. The subsea hydrocarbon assembly according to claim 10, wherein a dual bore excess material is removed from an outer surface of the common master valve block so that the lower cylindrical portion is centered around an eccentric interface axis that is collinear with the tubing hanger central axis.

14. The subsea hydrocarbon assembly according to claim 10, wherein the main bore is in fluid communication with a hanger main bore of the dual bore subsea wellhead assembly.

15. A method of completing a subsea hydrocarbon well, the method comprising:

providing a configurable common master valve block with a main bore, the main bore extending axially through the common master valve block from a bottom end of the common master valve block to a top end of the common master valve block and centered around a main central axis of the common master valve block, the common master valve block having an upper cylindrical portion centered around the main central axis, and a lower cylindrical portion with a central lower axis of an outer diameter of the lower cylindrical portion that is parallel to, and radially offset from, the main central axis;

identifying a target subsea assembly to which the common master valve block is to be secured;

if the subsea assembly has a mono bore subsea wellhead, machining a lower interface in the bottom end of the common master valve block that is centered around the main central axis;

if the subsea assembly has a dual bore subsea wellhead, machining a lower interface in the bottom end of the common master valve block that has an eccentric interface axis that is parallel to, and offset from, the main central axis; and securing the common master valve block to the subsea assembly.

16. The method according to claim 15, further comprising machining an outer surface of the lower cylindrical portion to remove excess material.

17. The method according to claim 16, further comprising:

if the subsea assembly has the mono bore subsea wellhead, machining the outer surface so that the lower cylindrical portion is centered around the main central axis; and if the subsea assembly has the dual bore subsea wellhead, machining the outer surface so that the lower cylindrical portion is centered around the eccentric interface axis.

18. The method according to claim 15, further comprising machining at least one crossover bore in the common master valve block, the at least one crossover bore providing fluid communication between the main bore and a master block annulus bore.

19. The method according to claim 18, further comprising:

a main lateral bore in fluid communication with the main bore and having a production wing valve;

an annulus lateral bore in fluid communication with the master block annulus bore, the master block annulus bore extending axially through the common master valve block and being parallel to, and offset from, the main bore, the annulus lateral bore having an annulus wing valve; and wherein the at least one crossover bore is in fluid communication with the main lateral bore radially interior of or radially exterior of the production wing valve;

the at least one crossover bore is in fluid communication with the annulus lateral bore radially interior of or radially exterior of the annulus wing valve;

the production wing valve has a common location regardless if the subsea assembly has the mono bore subsea wellhead or the dual bore subsea wellhead; and the annulus wing valve has a common location regardless if the subsea assembly has the mono bore subsea wellhead or the dual bore subsea wellhead.

20. The method according to claim 15, further comprising:

machining a main bore outlet in the common master valve block, the main bore outlet located at an end of a main lateral bore that is in fluid communication with the main bore;

machining an annulus bore outlet in the common master valve block, the annulus bore outlet located at an end of an annulus lateral bore that is in fluid communication with a master block annulus bore, the master block annulus bore extending axially through the common master valve block and being parallel to, and offset from, the main bore; and wherein a position of the main bore outlet is predetermined and standardized, irrespective of whether the subsea assembly has the mono bore subsea wellhead or the dual bore subsea wellhead; and a position of the annulus bore outlet is predetermined and standardized, irrespective of whether the subsea assembly has the mono bore subsea wellhead or the dual bore subsea wellhead.

* * * * *